United States Patent [19]

Wax

[11] 4,272,697

[45] Jun. 9, 1981

[54] SPARK PLUG WITH ANNULAR RINGS IN INSULATING CORE CHANNELS FORMING SERIES GAP

[76] Inventor: Bernard Wax, P.O. Box 197, Succasunna, N.J. 07876

[21] Appl. No.: 16,183

[22] Filed: Mar. 1, 1979

[51] Int. Cl.[3] ..... H01T 13/02; H01T 13/22

[52] U.S. Cl. ..... 313/123

[58] Field of Search ..... 313/123

[56] References Cited

U.S. PATENT DOCUMENTS

| | | | |
|---|---|---|---|
| 1,092,322 | 4/1914 | Witter | 313/123 |
| 1,125,097 | 1/1915 | Hilliker et al. | 313/123 |
| 1,505,373 | 8/1924 | Carpenter | 313/123 |
| 1,561,355 | 11/1925 | Polson et al. | 313/123 |
| 1,660,635 | 2/1928 | Thompson | 313/123 |
| 2,208,059 | 7/1940 | Stahr | 313/123 |
| 3,577,170 | 5/1971 | Nylen | 313/123 |

FOREIGN PATENT DOCUMENTS

| | | | |
|---|---|---|---|
| 1033859 | 7/1953 | France | 313/123 |
| 282008 | 3/1928 | United Kingdom | 313/123 |

*Primary Examiner*—Robert Segal

*Attorney, Agent, or Firm*—Rudolph J. Jurick

[57] ABSTRACT

A spark plug having one or more neutral electrodes cooperating with main and ground electrodes to provide a plurality of sparks during each firing cycle of the plug.

1 Claim, 7 Drawing Figures

SPARK PLUG WITH ANNULAR RINGS IN INSULATING CORE CHANNELS FORMING SERIES GAP

BACKGROUND OF THE INVENTION

Spark plugs having a plurality of electrodes for providing multiple sparks during each firing cycle of the plug are well known.

Hilliker et al U.S. Pat. No. 1,125,097, Jan. 19, 1915, discloses a spark plug having a pair of fixed electrodes spaced to either side of a rotatably mounted neutral electrode. The neutral electrode can be set with respect to the fixed electrodes to provide either a single or a double spark gap.

Carpenter U.S. Pat. No. 1,505,373, Aug. 19, 1924, discloses a spark plug having a rotatably mounted center electrode and a plurality of ground electrodes, the center electrode having a multi-pointed head. Interposed between the center and ground electrodes are a plurality of neutral electrodes. Upon firing, a double spark occurs between the center electrode, a neutral electrode and a ground electrode.

Thompson U.S. Pat. No. 1,660,635, Feb. 28, 1928, discloses a spark plug having two spark gaps. One gap is formed between a ground electrode and the peripheral surface of a flat metal plate and the other gap is formed between a center electrode and the wall defining a hole formed in the plate.

Stahr U.S. Pat. No. 2,208,059, July 16, 1940, discloses a spark plug in which the main electrode is mounted off-center with respect to the axis of the core. A neutral electrode extends from an end of the core and is disposed between the main electrode and a ground electrode.

The prior constructions are expensive and difficult to manufacture. Spark plugs made in accordance with this invention are of simple, rugged and inexpensive construction, and are readily adapted to provide either two or more than two sparks during each firing cycle.

SUMMARY OF THE INVENTION

A spark plug comprising main electrode carried by a core and having an offset end portion extending along the end surface of the core. A neutral electrode comprises a ring member disposed in an annular channel formed in the peripheral surface of the core. A first spark gap is formed between the end portion of the main electrode and a proximate portion of the ring member, and a second spark gap is formed between another portion of the ring member and a ground electrode. A plug having three spark gaps includes a second ring member disposed in a second annular channel formed in the core.

An object of this invention is the provision of an improved spark plug constructed to provide a plurality of sparks during each firing cycle of the plug.

An object of this invention is the provision of a spark plug having a plurality of electrodes constructed and arranged to form a plurality of spark gaps, at least one of such electrodes being a ring member disposed in an annular channel formed in the peripheral surface of the insulating core of the plug.

The above-stated and other objects and advantages of the invention will become apparent fromthe following description when taken with the accompanying drawings. It will be understood, however, that the drawings are for purposes of illustration and are not to be construed as defining the scope or limits of the invention, reference being had for the latter purpose to the claims appended hereto.

BRIEF DESCRIPTION OF THE DRAWINGS

In the drawings wherein like reference characters denote like parts in the several views.

DESCRIPTION OF PREFERRED EMBODIMENTS

Figure 1:
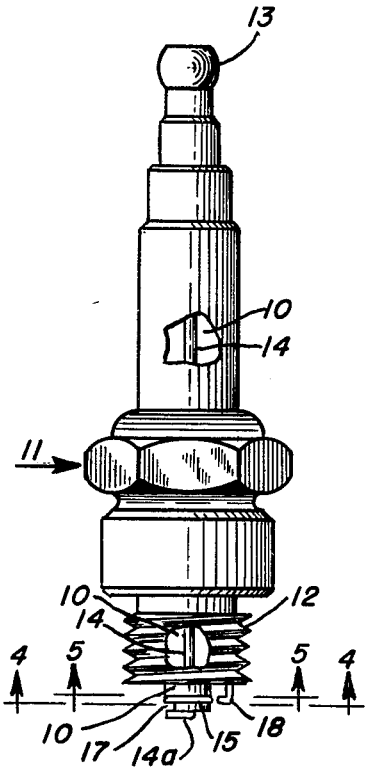
FIG. 1 is a side elevational view of a spark plug made in accordance with one embodiment of this invention, with a portion of the shell and core broken away.
Figure 3:
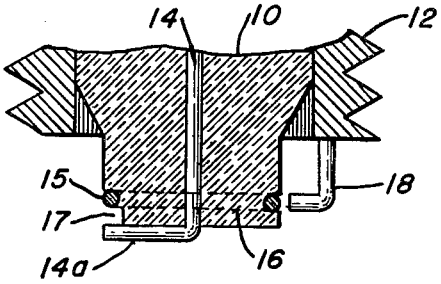
FIG. 3 is a fragmentary cross-sectional view taken along the line 3—3 of FIG. 2 and drawn to an enlarged scale.
Figure 4:
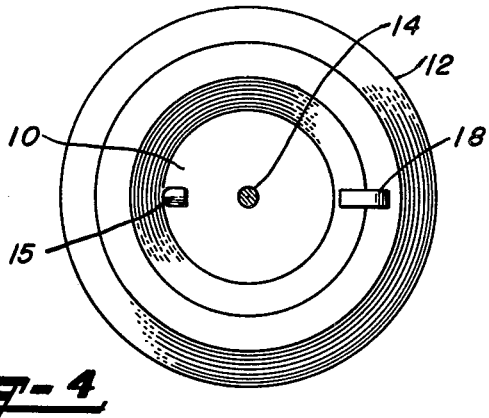
FIG. 4 is a cross-sectional view taken along the line 4–4 of FIG. 1.
Figure 2:
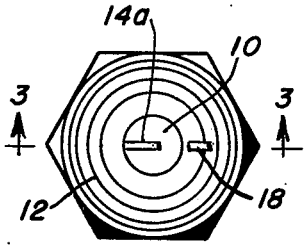
FIG. 2 is a bottom end view thereof.
Figure 5:
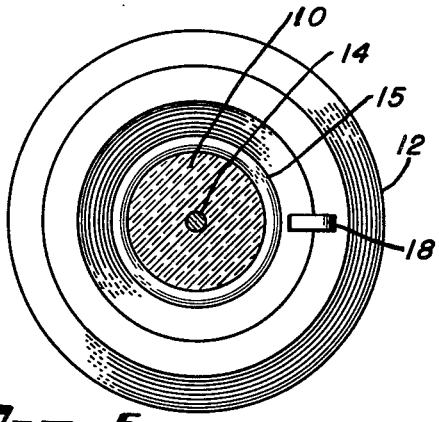
FIG. 5 is a cross-sectional view taken along the line 5—5 of FIG. 1.

Reference now is made to FIGS. 1–5 showing a spark plug having electrodes constructed and arranged to provide two sparks during each firing cycle of the plug. The spark plug comprises an insulating core 10, a metal shell 11 provided with a threaded portion 12, and a metal terminal 13 for connection of the plug to the ignition system of an internal combustion engine. A main electrode 14 has an exposed, offset end portion **14*a* which extends along the flat end surface of the core 10. A ring member 15 is positioned in an annular channel 16 formed in the peripheral surface of the core. Also formed in the core is a relatively narrow radial opening 17, which communicates with the annular channel containing the ring member 15. Such slot extends to the end of the core 10 and is spanned by the end of the offset end portion 14*a* of the main electrode. The ground electrode 18 has an end spaced from the ring member 15, preferably at a point diammetrically opposite to the location of the radial opening 17. The space between the offset end portion of the main electrode and the ring member, that is, the length of the opening 17 taken longitudinally of the core 10, constitutes one spark gap of the plug, the other spark gap being the space between the ring member and the free end of the ground electrode 18**. Thus, when an appropriate voltage is applied across the main and ground electrodes a first spark will jump from the end portion of the main electrode through the slot and to the proximate portion of the ring member, and a second spark will jump between the ring member and the ground electrode. These sparks occur at diammetrically opposed areas of the spark plug resulting in a faster fuel burn rate and a more complete combustion of the fuel mixture, thereby increasing the horsepower output of the engine and minimizing pollutants exhausted into the atmosphere.

Figure 7:
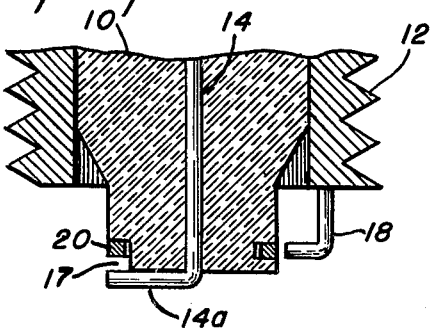
FIGS. 6 and 7 are similar to FIG. 3 but showing an electrode arrangement made in accordance with another embodiment of this invention.

As shown in FIGS. 1–5, the ring member 15 has a circular cross-sectional configuration. However, the ring member may have other cross-sectional configuration as, for example, the square configuration of the ring member 20 shown in FIG. 7.

Figure 6:
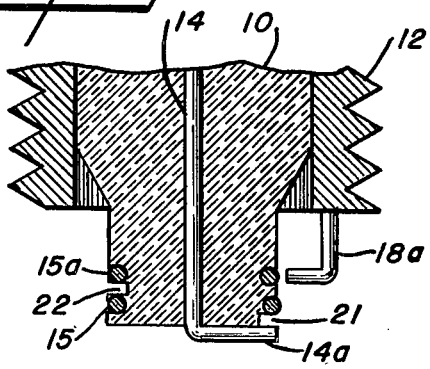

Reference now is made to FIG. 6 wherein there is shown an arrangement for providing three sparks during each firing cycle of the plug. Here two axiallyspaced ring members 15 and 15*a* are disposed, individually, in spaced arcuate channels formed in the peripheral surface of the core 10. The offset end portion 14*a* of the main electrode is directed toward the ground electrode 18*a* and extends over a first radial opening 21 formed in the core. A second radial opening 22 communicates with the two arcuate channels. Thus, a first spark will jump between the end portion of the main electrode and the proximate portion of the ring member 15, a second spark will jump between those portions of the two ring members which extend across the radial opening 22 and a third spark will jump between the ring member 15*a* and the end of the ground electrode.

Having now described the invention what I desire to protect by Letters patent is set forth in the following claims.

I claim:

1. A spark plug comprising, (a) an insulating core carried by a metal shell, (b) an annular channel formed in the peripheral surface of the core, (c) a metal ring member disposed in the said channel, (d) a main electrode carried by the core and having a radially-offset end portion spaced from said ring member, (e) a radial opening formed in the core and extending between the said ring member and the offset end portion of the main electrode, (f) a second annular channel formed in the peripheral surface of the core, (g) a second metal ring member disposed in said second channel, (h) a second radial opening formed in the core and extending between the two annular channels, the two openings formed in the core being located substantially on opposite ends of the core diameter, and (i) a ground electrode carried by the said shell and spaced from said second ring member.

* * * * *